United States Patent [19]

Capawana

[11] Patent Number: 4,939,979

[45] Date of Patent: Jul. 10, 1990

[54] MACHINEGUN AMMUNITION CONTAINER RELATIONSHIP TO OTHER APPLICATIONS

[76] Inventor: Ross Capawana, 3250 Pollux Ave., Las Vegas, Nev. 89102

[21] Appl. No.: 162,098

[22] Filed: Feb. 29, 1988

Related U.S. Application Data

[63] Continuation-in-part of Ser. No. 929,339, Nov. 12, 1986, abandoned.

[51] Int. Cl.[5] ..... F41C 25/02

[52] U.S. Cl. ..... 89/34; 42/50

[58] Field of Search ..... 89/34, 33.2, 33.1, 33.14; 42/49.01, 49.02, 50

[56] References Cited

U.S. PATENT DOCUMENTS

| | | | |
|---|---|---|---|
| 607,681 | 7/1898 | Cochrane | 89/33.1 |
| 661,201 | 11/1900 | Wilding | 89/34 |
| 698,107 | 4/1902 | deKnight | 89/33.2 |
| 1,525,066 | 2/1925 | Browning | 89/33.2 |
| 2,289,067 | 7/1942 | Owsley | 42/50 |
| 2,573,774 | 11/1951 | Sandberg | 89/34 |
| 2,740,180 | 4/1956 | Nobles | 89/33.14 |
| 3,191,332 | 6/1965 | Ardolino | 42/50 |
| 3,293,986 | 12/1966 | Stoner | 89/34 |
| 3,974,739 | 8/1976 | Bourlet | 89/34 |
| 4,658,700 | 4/1987 | Sullivan | 89/33.02 |

FOREIGN PATENT DOCUMENTS

| | | | |
|---|---|---|---|
| 1126545 | 9/1968 | United Kingdom | 89/34 |

*Primary Examiner*—Deborah L. Kyle
*Assistant Examiner*—Stephen Johnson
*Attorney, Agent, or Firm*—Quirk, Tratos & Roethel

[57] ABSTRACT

An ammunition container for an M60 machinegun is a one piece molded plastic box having a rigid strap spaced from a front wall thereof for mounting over the bandolier supporter of the machinegun. The mounting strap has interior bosses adapted to center the container on the gun and to lock the container in place, minimizing movement of the container which might jam the gun. A removable cover may be either molded intergrally with the container by means of a hinge, or may be separate and slideably removable.

16 Claims, 6 Drawing Sheets

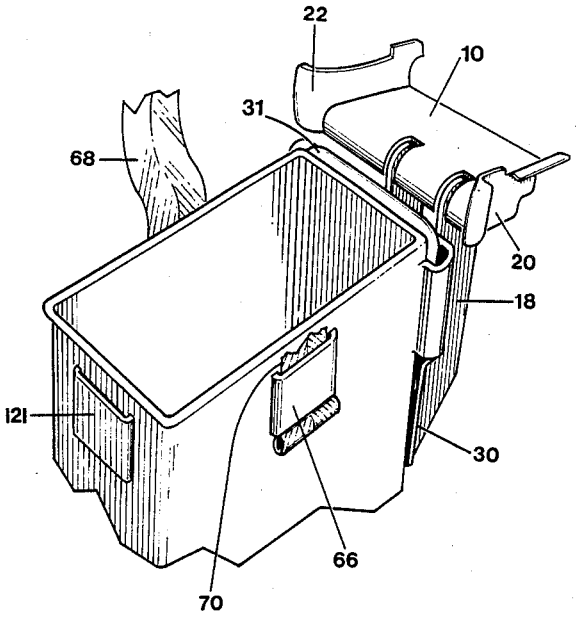
FIG. 2
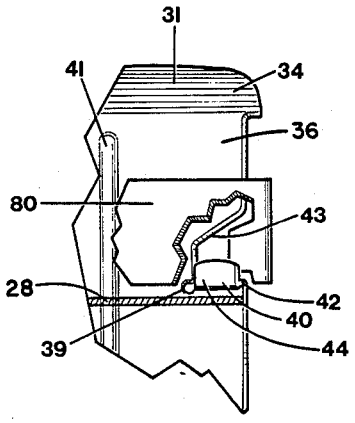
FIG. 3
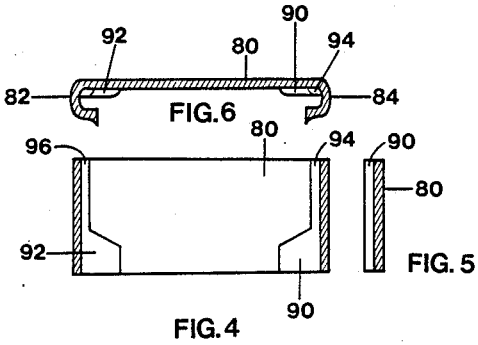

MACHINEGUN AMMUNITION CONTAINER RELATIONSHIP TO OTHER APPLICATIONS

This application is a continuation in part of application Ser. No. 929,339, filed Nov. 12, 1986, now abandoned entitled Machine Ammunition Container.

BACKGROUND OF THE INVENTION

This invention relates to a magazine for holding machinegun ammunition. More particularly, the invention relates to a molded rigid plastic container having an integral strap adapted to fit on a bandolier supporter for an M60 machinegun.

The M60 machinegun, manufactured by Maremont Corporation of Saco, Me., has been an important military and police weapon for many years, and is widely used by the armed forces of the U.S. and many other countries. The M60 machinegun and its operation are described in detail in Department of the Army Field Manual FM 23-67 entitled "Machinegun 7.62-MM, M60", issued by the Department of the Army, U.S.A., Oct., 1964. While this weapon has proved to be very effective, occasionally problems exist with the ammunition feed system. Ammunition is packaged in 100 round belts or bandoliers packaged in cardboard boxes which are placed in a cloth sack and are attached to the feed tray of the machinegun with a webbed belt. The cardboard box must be torn open prior to inserting into the sack, and this is sometimes a difficult act in the field. In addition, the mounting of the cardboard box on the side of the gun provides a flexible, somewhat unstable structure which can possibly cause a jam in the gun during strenuous usage. Furthermore, in wet climates, the box sometimes tends to disintegrate. Also, once a box of ammunition is partially used, it cannot be resealed to keep out moisture and debris. The problems with existing machinegun magazines are noted in an article entitled "A Magazine for the Machinegun" in INFANTRY magazine, Nov./Dec. 1985 issue, page 18.

The invention provides a container for M60 machinegun ammunition that provides substantial advantages in terms of cost, reliability, and operability. The container is a single-piece, molded plastic box having a cover which is either hinged or slideably removable. The box has a mounting strap or hanger which fits over the existing bandolier supporter and automatically locks into place, resulting in a stable structure which insures that an jam will not be caused by the ammunition container under strenuous usage. Since the box is made from plastic, it does not disintegrate when wet, and can be made from a transparent material for easy viewing of the amount of ammunition left in the box. The container of the invention is easier and faster to load than the existing system, since it is entirely rigid and slides on quickly without the necessity of wrapping a flexible strap in place around the bandolier supporter. In addition, since the container has a quickly replaceable top, the amount of moisture and debris which is likely to enter the container in field usage can be minimized. It has also been found that the ammunition belt has less friction sliding over the plastic box than a cloth bag, and operation of the gun with the container of the invention is quieter, since the container helps to maintain tension on the ammunition belt. In addition, if necessary the containers of the invention can be reused.

In general, the ammunition container of the invention is adapted to fit over the existing bandolier supporter mounted on the side of the M60 machinegun. The container has a molded strap spaced from the box and extending around a portion of the forward exterior periphery of the box. The strap is configured with internal bosses adapted to mate with indentations on the existing bandolier supporter, and is configured to lock into place on the bandolier supporter to preclude rotational or vertical movement.

Accordingly, it is an object of the invention to provide an ammunition container for the M60 machinegun which is simple and inexpensive to manufacture, and which reliably provides a rigid, non-movable support for ammunition belts. It is another object of the invention to provide an ammunition container which does not deteriorate in field usage, and which reduces the amount of moisture and debris which can enter the container with a risk of corroding or clogging the gun. It is yet another object of the invention to provide an ammunition container which can be easily and rapidly mounted and dismounted from the gun, yet which provides a firm, stable structure while in place. These and other objects are satisfied by the container of the invention, a detailed description of which is provided herein.

BRIEF SUMMARY OF THE INVENTION

An ammunition container for M60 machinegun ammunition belts comprises a rigid, molded plastic box having a width slightly greater than the length of a machinegun bullet. The box has an exterior mounting strap spaced from an end portion of the box, the strap being engageable with the bandolier supporter of the machinegun by sliding the strap over the top portion of the supporter. A series of bosses or projections on an interior surface of the mounting strap of the container mate with existing indentations on the bandolier supporter, providing a locking interengaging fit of the strap to the machinegun. A cap is attached to the box, either by a molded hinge at a rear portion of the box or by means of channels along the sides of the top which slideably engage flanges along the box periphery.

BRIEF DESCRIPTION OF THE DRAWINGS

The invention is best understood with respect to the drawings, in which:

FIG. 2 is a partial perspective view showing the mounting mechanism;

FIG. 3 is a partial cutaway view showing the particular engagement of the mounting strap of the container with the bandolier supporter;

FIGS. 4, 5, and 6 are a partially sectioned inside view, end view, and top view, respectively, of the container mounting strap;

DETAILED DESCRIPTION OF A PREFERRED EMBODIMENT

Figure 1:
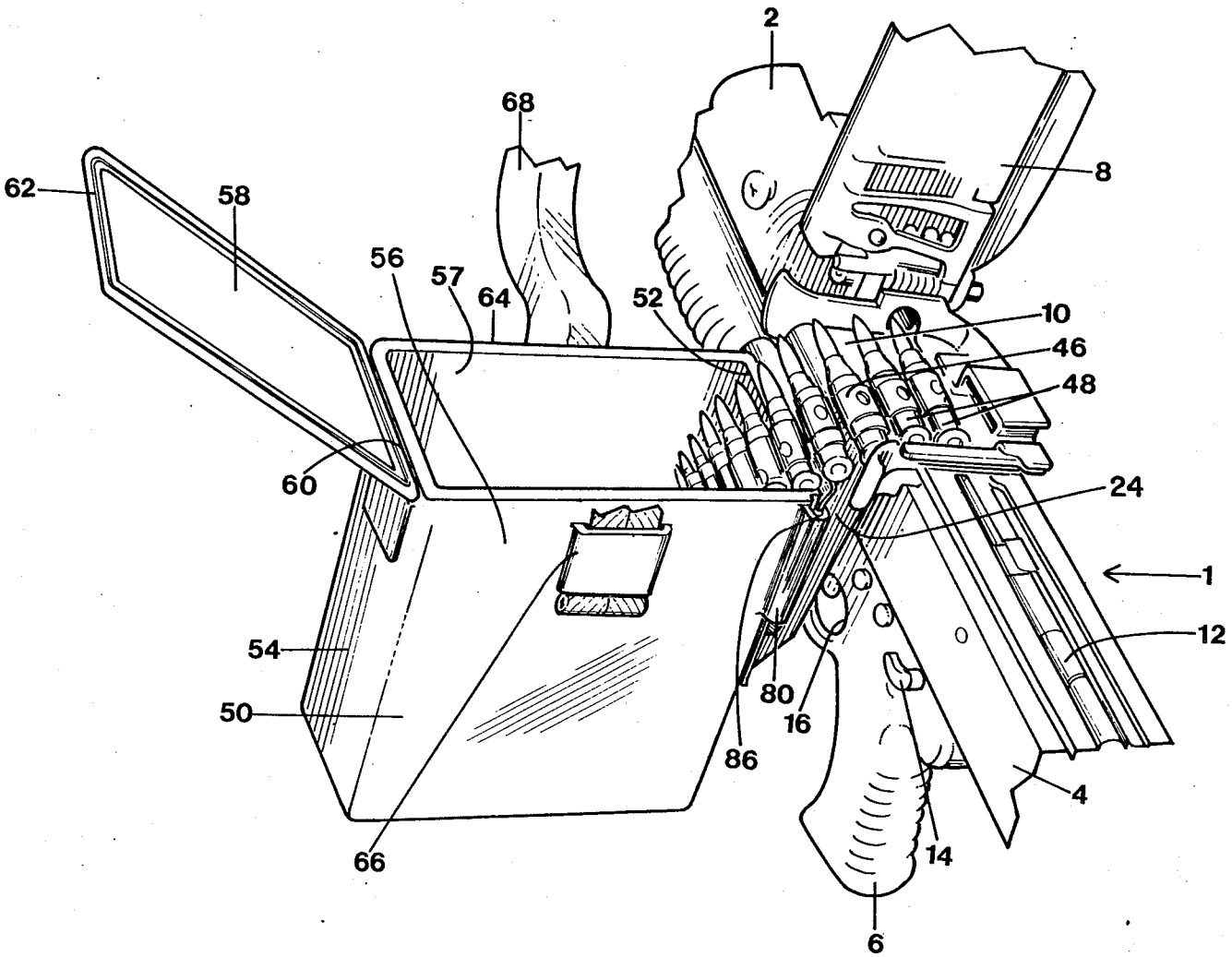
FIG. 1 is a perspective view showing a container of the invention mounted on the side of an M60 machinegun.

Referring first to FIG. 1, M60 machinegun 1 is a conventional 7.62-MM, M60 machinegun manufactured by Maremont Corp. The gun has a barrel 2, a receiver 4, a handle 6, a feed cover assembly 8, and a bolt 12. A safety 14 precludes operation of the trigger 16 except when the gun is desired to be placed in operating mode.

A bandolier or belt 46 of machinegun bullets 48 is fed to the feed port of the gun over rollers 18 (see FIG. 2) of feed tray 10. A pair of vertical ammunition guides 20 and 22 on each side of the feed tray guide the ammunition into the feed tray groove.

The bandolier supporter 24 is mounted on the side of the machinegun adjacent to and below the feed tray 10. The support is a conventional portion of the M60 machinegun, and, as best seen in FIGS. 2 and 3, consists of a vertical mounting plate 30 spaced from a hanger member which depends from the feed tray. A horizontal spacing ledge 28 extends outwardly from a machine gun and separates the vertical mounting plate from the feed tray. A sloped upper guide portion 31 of the mounting plate acts as a guide for the ammunition belt as it exits the container. A pair of ears 32 and 34 at the sides of guide portion 31 are designed to hold the flexible belt from the conventional sack into which boxes of ammunition are placed; while these ears exist on the ends of the bandolier supporter as it is manufactured commercially, they provide no function with respect to the container of the invention other than to assist in guiding the mounting bracket of the container into its proper position for loading.

As constructed by the manufacturer, the bandolier supporter also has two identical indentations just above the spacer 28 on either side of the supporter; one of the indentations 43 is shown in FIG. 3. The indentation is a notch in the upper portion 36 of the vertical mounting plate 30; a lug or tooth 40 consisting of a horizontal ledge 42 and a vertical flange 44 extend rearwardly (i.e., toward the machinegun) from the mounting plate 30. A small circular aperture 39 is located at a bottom portion of the notch 43; this aperture remains from the manufacturing process for the bandolier supporter and has no function in its use. An identical notch and tooth support exists on the opposite side of the bandolier supporter. Similarly, a pair of vertical structural ribs (one of which is shown as 41 in FIG. 3) exist on the conventional supporter.

The ammunition container 50 of the invention is a rectangular box having a bottom wall 51, a front wall 52, a rear wall 54, and side wall 56 and 57. A flat top provides a cover means to enclose the interior chamber of the box; the top is attached to the remainder of the container by a flexible hinge member 60. The hinge is simply a flexible piece of plastic molded between the container and the top. The entire box is a one piece unit molded from plastic, such as polyethylene, polypropylene, polyvinylchloride, or polycarbonate. The preferred material of manufacture is polypropylene. A rectangular continuous groove 62 around the inside portion of the covering member 58 press fits to the peripheral lip 64 of the container. When the top is closed and pressed onto the bottom portion of the container, the edges of the peripheral groove grip the top of the container and the top is maintained in place by friction. No separate latches or locks are required.

A carrying strap 68 is conventionally mounted in a pair of strap holders 68, which are simply molded loops in each side of the container. Any type of mounting means for the strap is acceptable. Another strap mount 121 is mounted at the rear of the container; this mount may also be used for attaching a second ammunition container.

A very important part of the ammunition container of the invention is the mounting means for removably attaching the container to the machinegun. The mounting bracket, best seen is FIGS. 2–6, consists of an arm 80 parallel to and spaced from the front wall 52 of the container thus forming a narrow slot to receive the mounting plate of the bandolier supporter. Mounting bracket 80 has a pair of U-shaped end portions 82 and 84 (best seen in FIG. 6) which attach to side walls 57 and 56, respectively (e.g. at 86). Accordingly, the slot for receiving the bandolier supporter maintains a uniform width along the entire front wall of the container.

As shown in FIGS. 3–6, a pair of lugs or bosses 90 and 92 having "h" shapes corresponding to the shape of the notches in the bandolier supporter are molded into the inside portion of the mounting bracket 80. The lower portion of the bosses matches the notches, while the upper portions 94 and 96 of the bosses act as centering guides for mounting plate 30 of the bandolier supporter. When the container is fixed in position on the machinegun as shown in FIGS. 1 and 2, the lower portion of the bosses extends into the notch in the mounting plate, and the edge of the mounting plate abuts the interior edge of the upper portions 94 and 96 of the bosses. Consequently, the space between the upper portion of the bosses is equal to the width of the mounting plate. Accordingly, when the container mounting bracket is slideably engaged with the mounting plate of the bandolier supporter, the container locks into position automatically when the bosses engage the notches on either side of the mounting plate. The bosses provide a stabilizing means for precluding undesirable movement of the container while the gun is in use. The width of the slot between the mounting bracket 80 and the front wall 52 of the container is approximately ⅛"; the thickness of bosses 90 and 92 is approximately 1/16". The entire container is approximately 6"×5"×3" in size.

Figure 7:
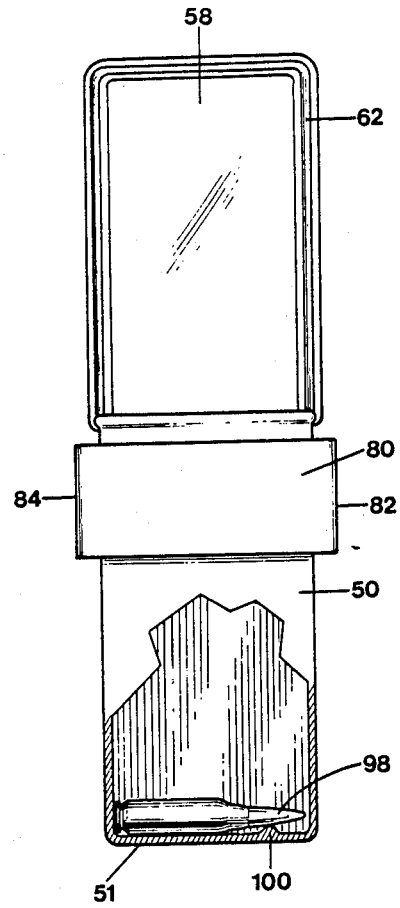
FIG. 7 is a front view of the container partially cutaway to show a bullet resting in the container.

The cutaway drawing in FIG. 7 shows the existence of a longitudinally transverse mounting rib 100 which extends between the front and rear walls along the bottom of the container. The rib is designed to support the nose portion of the bullet 98 to maintain the axis horizontal. This feature simply assists in maintaining a problem-free feed for the gun, and also leaves a small area at the bottom of the container where particulate matter and moisture can collect without affecting the bottom row of bullets.

Figure 8:
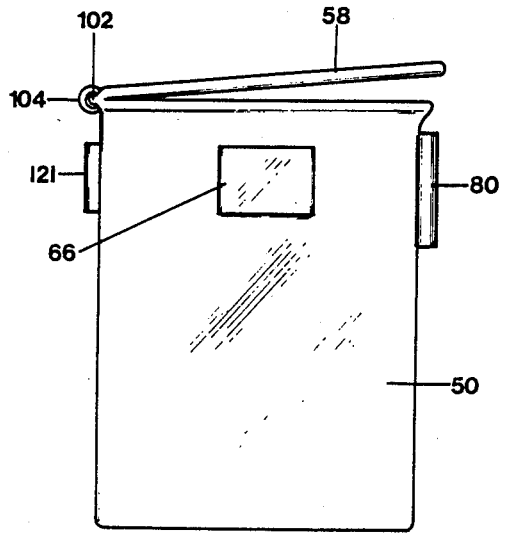
FIG. 8 is a side view of the container.
Figure 9:
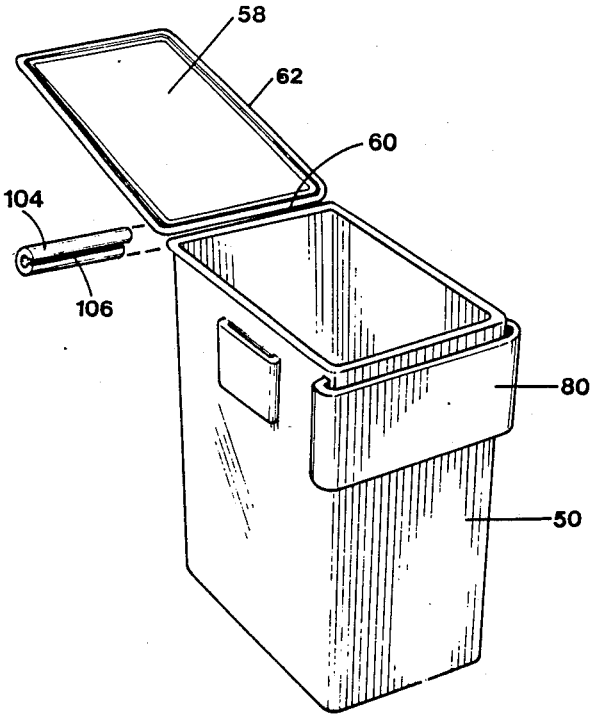
FIG. 9 is a perspective view of the container showing the spring clip in exploded view.
Figure 10:
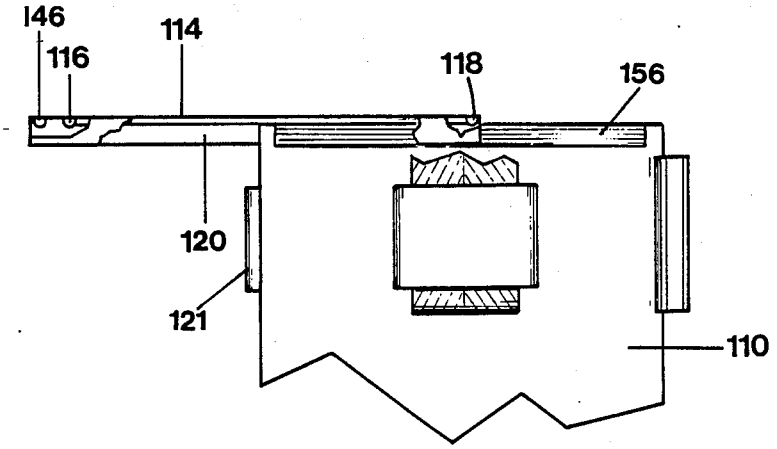
FIG. 10 is a partial side view of an alternate embodiment of the invention showing a different type of top.
Figure 11:
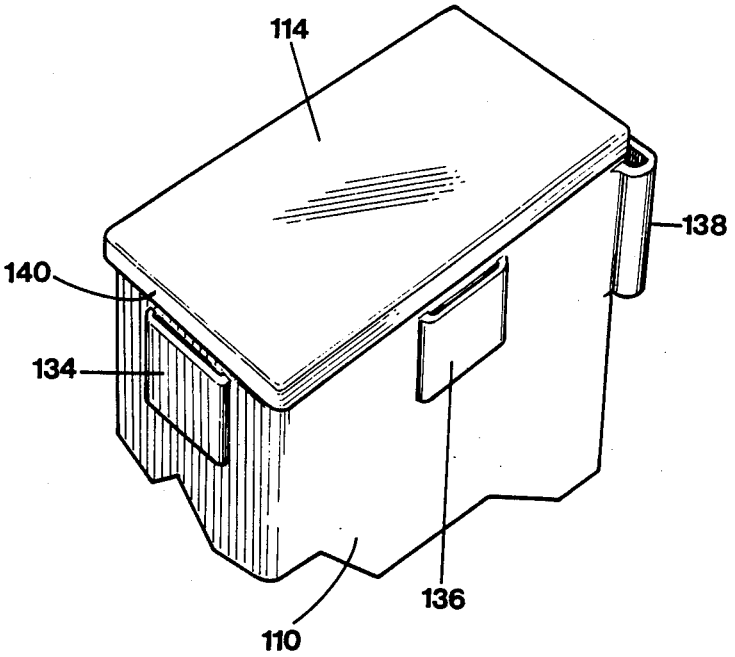
FIG. 11 is a perspective top view of the embodiment shown in FIG. 10.
Figure 12:
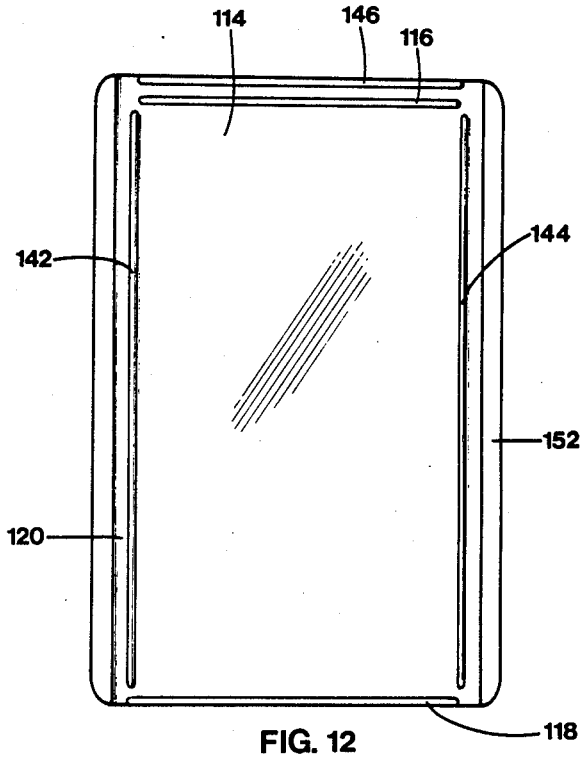
FIG. 12 is a bottom view of the cover of the embodiment shown of FIG. 10.
Figure 13:
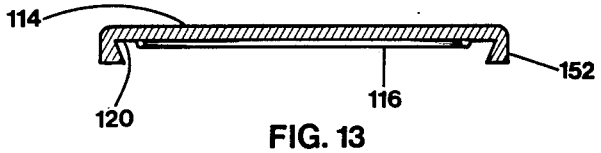
FIG. 13 is a transverse section of the cover of FIG. 12.

As shown in FIGS. 8 and 9, in one embodiment of the invention the cover or cap 58 is hinged at its rear portion by means of a molded web connecting the base of the container with the top. If desired, the cap may be biased to a closed position by sliding an elongate C-shaped clip 104 over the bead 102 at the rear portion of the container. As shown in FIG. 9, the C-shaped clip has a channel 106 which slides over the webbed member and biases the cap into the closed position. When the container is attached to the gun for use, the clip is removed and discarded.

An alternate, and preferred, embodiment of the cap for the container of the invention is shown in FIGS. 10–13. The container 110 has an outwardly extending lip 156 around the periphery of the container. The container has a bandolier hanger 138, and strap mount, and a rear bracket 134. The top 114 has a downwardly extending peripheral lip 140 around the side and rear edges. The top 114 of the container also has a pair of C-shaped side channels 120 (see FIG. 13) which slideably engage the sides of the the peripheral lip. A pair of rear ribs or beads 116 and 146, extend transversely between the sides of the top at the rear. A similar transverse bead 118 protrudes downwardly at the front of the top. When the top is completely closed, beads 118 and 116 extend over the front and rear ends of the box. These beads act as stops to maintain the cover in place, but can be easily overcome by exerting slight downward pressure on the center of the cover prior to removing the cover. Longitudinal beads 142 and 144 extend parallel to flanges 120 and 152 and form a channel to slideably receive the upper peripheral side edges 156 of the container.

Figure 14:
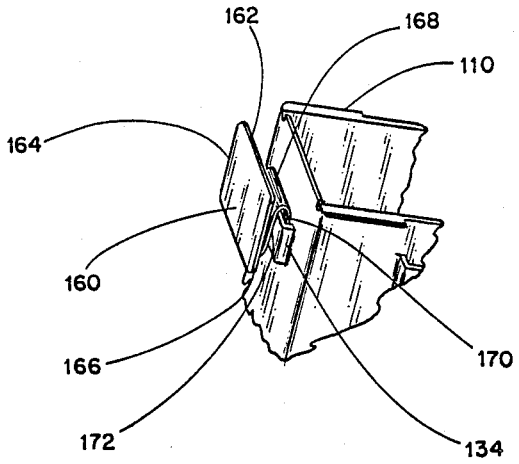
FIG. 14 is a partial view of the rear of the container having a hanger for a second similar ammunition

FIG. 14 shows an embodiment of the invention in which a second ammunition container may be mounted in tandem with the use of a simple clip or hanger which mounts at the rear of a container. In the drawing, container 110 has a rear bracket 134 consisting of a spaced arm 170. A removable container hanger has a flat, rectangular mounting plate 160 having parallel side edges 164 and 166, and top edge 162. A hanger portion 168 consisting of an inverted U-shaped member attaches to the rear of plate 160. The U-shaped clip slides over the arm 170 of the mounting bracket, as shown, with mounting plate 160 aligning parallel to the rear wall of container 110. A second container identical to 110 may be attached to the mounting plate, with the bandolier hanger 138 extending over the plate. In this manner, two containers may be easily transported together for rapid exchange.

It will be readily apparent to those skilled in the art that a number of changes and alterations may be made within the spirit and scope of the invention without departing from the inventive concepts set forth earlier. Accordingly, the invention should not be considered limited by the specific embodiments thereof disclosed herein, but rather should be considered limited only by the following claims.

I claim:

1. A machinegun ammunition container for removably mounting on a bandolier supporter of a M60 machinegun comprises a box having a bottom, enclosed side walls, and an open top, a mounting strap comprising a flat, rigid member spaced from a flat side wall of the container and substantially parallel to said flat side wall, said mounting strap having first and second ends supportively mounted to opposing side walls, a vertical slot defined by the flat side wall and the mounting strap, said vertical slot substantially horizontally spanning the flat side wall, said mounting strap being adapted to fit slideably over the bandolier supporter by extending the bandolier supporter upwardly through the vertical slot, and stabilizing means for reducing undesirable movement of the container when the container is mounted on the bandolier supporter of the machinegun comprising first and second boss means extending inwardly from end portions of the mounting strap adapted to engage first and second notch means on the bandolier supporter when the container is mounted on the bandolier supporter.

2. The container of claim 1 also comprising removable closure means for enclosing the container top.

3. The container of claim 2 wherein the closure means is slideably attached to container walls forming the open top of the container.

4. The container of claim 1 wherein the container is a one-piece molded plastic container.

5. The container of claim 4 also comprising mounting means for a flexible carrying strap.

6. The container of claim 1 also comprising a rear mounting bracket consisting of a spaced parallel arm attached to a container wall opposing the flat side wall from which the mounting strap is spaced and also comprising a removable mounting clip for attaching a second container having a second mounting strap, said clip comprising a hanger portion consisting of downwardly extending arm adapted to slideably interconnect with the rear mounting bracket, and a flat vertical plate adapted to slideably engage the second rigid mounting strap of a second ammunition container.

7. The container of claim 1 wherein the boss means comprises generally h-shaped lugs having a uniform thickness.

8. In combination, a M60 machinegun having a bandolier supporter comprising a generally vertical mounting plate spaced from the gun and having opposing notches in side portions of the plate, and further having support means extending rearwardly from the plate below the opposing notches, and an ammunition container mounted on the bandolier supporter, said ammunition container comprising a molded plastic box having a bottom wall, enclosed side walls, and an open top, a mounting strap comprising a generally flat, rigid member spaced from a flat side wall of the container, said mounting strap resting on and being supported by the support means of the bandolier supporter, said mounting strap being substantially parallel to said flat side wall, said mounting strap having a first end portion supportively connected to a side wall and a second end portion supportively connected to a side wall, the mounting strap also comprising stabilizing means for limiting movement of the container of the machine gun, a vertical slot defined by the flat side wall and the mounting strap, said vertical slot substantially horizontally spanning substantially the entire width of the flat side wall, the mounting plate extending through the vertical slot and the stabilizing means engaging the mounting plate, the stabilizing means comprising boss means extending inwardly from the mounting strap and engaging the opposing notches.

9. The combination of claim 8 wherein the stabilizing means comprises first and second boss means extending inwardly from first and second portions of the mounting strap.

10. The combination of claim 8 also comprising removable closure means for enclosing the container top.

11. The combination of claim 8 wherein the closure means is slideably attached to container walls forming the open top of the container.

12. The combination of claim 8 also comprising mounting means for a flexible carrying strap.

13. The combination of claim 8 wherein the container is a one-piece molded plastic container.

14. The combination of claim 8 also comprising a rear mounting bracket consisting of a spaced parallel arm attached to a container wall opposing the flat side wall from which the mounting strap is spaced, and also comprises a removable mounting clip for attaching a second container having a second mounting strap, said clip comprising a hanger portion consisting of a downwardly extending arm adapted to slideably interconnect with the rear mounting bracket, and a flat vertical plate adapted slideably engage the second rigid mounting strap of a second ammunition container.

15. The combination of claim 8 wherein the boss means comprises generally h-shaped lugs having a substantially uniform thickness.

16. The combination of claim 9 wherein the boss means comprise generally h-shaped lugs having a uniform thickness.

* * * * *